US006496565B2

(12) United States Patent
Matoba et al.

(10) Patent No.: US 6,496,565 B2
(45) Date of Patent: Dec. 17, 2002

(54) X-RAY FLUORESCENCE ANALYSIS APPARATUS

(75) Inventors: Yoshiki Matoba, Chiba (JP); Mitsuo Naito, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/827,123

(22) Filed: Apr. 5, 2001

(65) Prior Publication Data

US 2001/0038684 A1 Nov. 8, 2001

(30) Foreign Application Priority Data

Apr. 6, 2000 (JP) ..... 2000-104846

(51) Int. Cl.[7] ..... G21K 1/02
(52) U.S. Cl. ..... 378/147; 378/44
(58) Field of Search ..... 378/147, 44, 145

(56) References Cited

U.S. PATENT DOCUMENTS 4,109,156 A * 8/1978 Schroeder ..... 378/147
5,875,694 A * 3/1999 Graf ..... 84/461

* cited by examiner

*Primary Examiner*—Drew A. Dunn
(74) *Attorney, Agent, or Firm*—Adams & Wilks

(57) ABSTRACT

An X-ray fluorescence analysis apparatus in which a collimator for defining a range of passage of X-rays, can be safely and simply attached and detached by providing a right-hand screw thread for attachment of the collimator to a housing, an X-ray generator, or an X-ray detector, and further providing a left-hand screw thread on a side of the collimator opposite to that of the right-hand screw thread. An attachment jig having a left-hand screw thread corresponding to the left-hand screw thread provided on the collimator is used to attach and detach the collimator.

20 Claims, 3 Drawing Sheets

PRIOR ART

X-RAY FLUORESCENCE ANALYSIS APPARATUS

BACKGROUND OF THE INVENTION

The present invention relates to a fluorescent X-ray analysis apparatus for detecting secondary X-rays generated by a sample during irradiation with X-rays and carrying out elementary analysis.

An overview of the attachment and the detachment of the collimator of the X-ray fluorescence analysis apparatus with the thread mechanism for attachment and detachment of the collimator of the related art will be described in the following based on FIG. 2.

The collimator 4 is provided with circular indentations at 2 points which are further out than a hole on the collimator and on its diameter, and a jig 5 with a projection fits into the two indentations.

For attachment, the jig is hooked to the indentations of the collimator, the collimator is carried to the mounting point, and the thread section of the collimator is lined up with the thread section of the housing, the X-ray generator, or the X-ray detector, and the jig is then rotated.

For detachment, the projection of the jig is turned so as to line up with the indentation of the collimator, and after the thread has been detached, the indentation of the collimator is hooked onto the projection of the jig and then taken out from the inside of the housing.

However, in the method of the related art, there was a difficulty in rotating when screwing in or screwing out, and there was a danger of the collimator dropping off and damaging the detector, etc. inside the housing when carrying the collimator by hooking the indentation of the collimator with the projection of the jig.

Also, when the mounting position for the collimator was close to the direction in which gravity acts it was difficult to carry the collimator with the jig, making tools such as forceps necessary.

SUMMARY OF THE INVENTION

In order to resolve the foregoing problems, an external left-hand thread is provided coaxial on the opposite side of the side in which the right-hand thread of the collimator is formed, so that screw threads having opposite threading directions are provided on opposite sides of the collimator.

Also, utilizing a jig, having an internal left-hand thread with the same diameter as the external left-hand thread, and a cylindrical shape that is easy to operate with the structure around the mounting position, enables easy attachment and detachment.

Additionally, by providing the indentation (projection) for tightening on the collimator and the projection (indentation) for tightening on the jig, firm attachment is possible.

As mentioned above, in the fluorescence X-ray analysis apparatus in which the collimator is attached and detached by the thread mechanism, it is made possible to attach the collimator to and detach it from the housing, the X-ray generator, or the X-ray detector easily and safely by providing the left-hand thread on the collimator and preparing the cylindrical jig with the left-hand thread of the same diameter.

Firm attachment is also made possible by providing the indentation section and the projection section for tightening on the collimator and on the jig for attachment and detachment.

DETAILED DESCRIPTION OF THE PREFERRED EMBODIMENT (First Embodiment)

Figure 1:
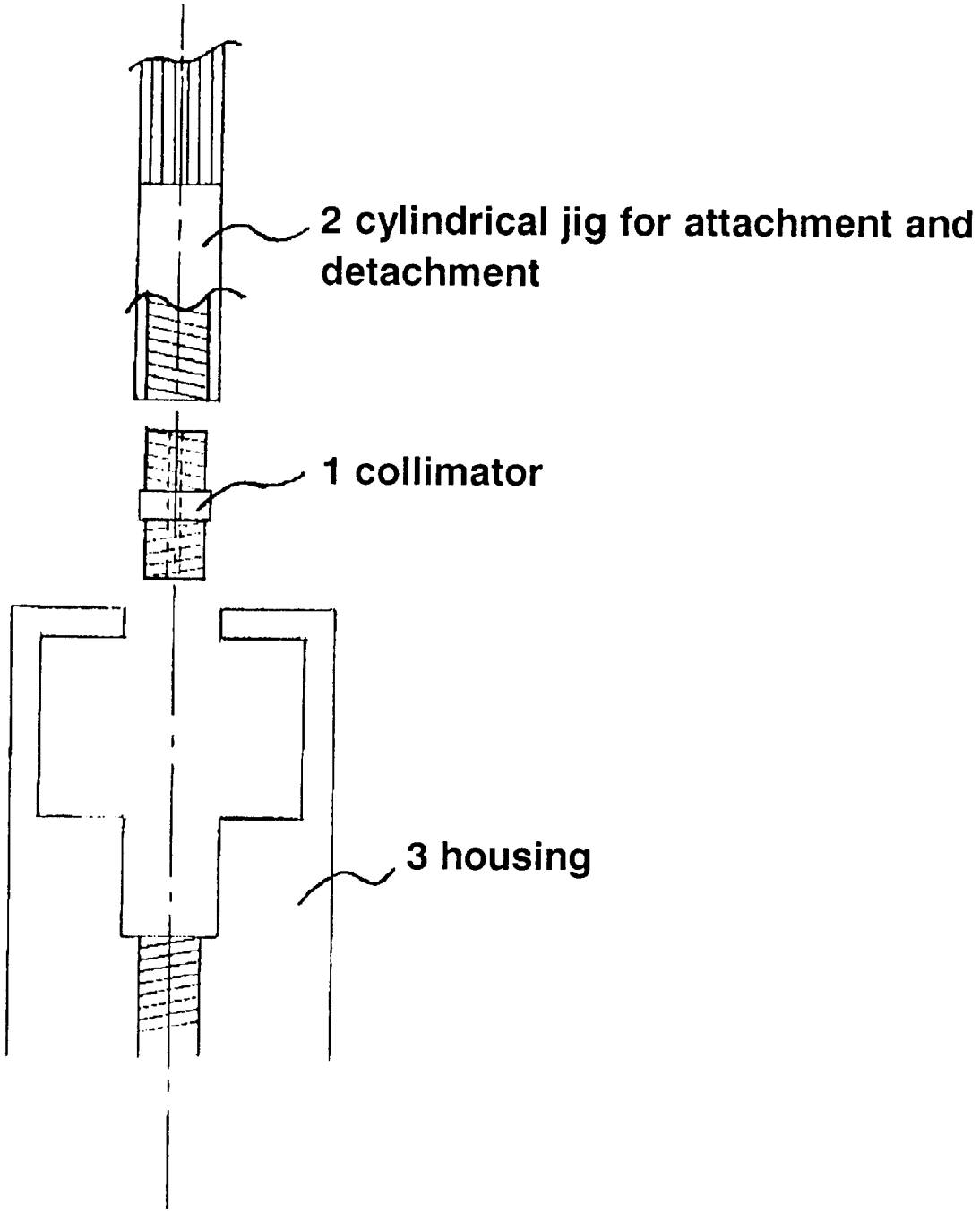
FIG. 1 is a schematic drawing showing the structure of the collimator attachment and detachment mechanism relating to the first embodiment of the present invention.
Figure 2:
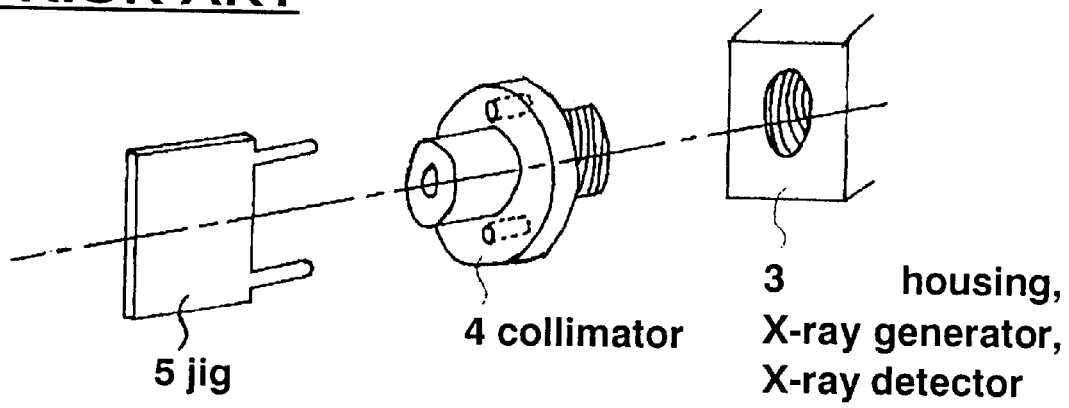
FIG. 2 is a schematic drawing showing the structure of the collimator attachment and detachment mechanism of the related art.

A first embodiment of the present invention will be described in the following based on FIG. 1.

1 is a collimator, and an external thread is cut on a housing attachment side, having a diameter the same as that of the internal thread at the mounting point of the housing.

On the opposite side to the housing attachment side, an external left-hand thread is provided coaxial with the external thread. 2 is a cylindrical jig for attachment and detachment with an internal left-hand thread having the same diameter as the external left-hand thread on the collimator.

The cross-sectional area of the jig 2 is smaller than the entrance area of the housing, and smaller than the area around the collimator mounting point, and it is sufficiently long for the operator to reach and work easily.

For attachment, the collimator is screwed anticlockwise into the jig for attachment and detachment until it stops.

Here, static frictional force is acting between the external left-hand thread of the collimator and the internal left-hand thread of the jig.

The external thread of the collimator is then screwed clockwise into the internal thread of the housing, using the grip part of the jig for attachment and detachment.

Here, the collimator is screwed into the housing until the dynamical frictional force acting between the external thread of the collimator and the internal thread of the housing exceeds the static frictional force.

At the instance when the dynamical frictional force exceeds the static frictional force, screwing of the collimator and the housing is terminated, but if rotation in the clockwise direction is continued, the left-hand threads on the collimator and the jig become disengaged due to the effect of the static frictional force between the collimator and the housing, and so only the collimator can be attached to the housing section easily.

On the contrary, to detach the collimator from the housing, the internal left-hand thread of the jig is aligned with the position of the external left-hand thread of the collimator and rotation in an anticlockwise direction is continued, then the internal left-hand thread of the jig becomes screwed into the external left-hand thread of the collimator by the effect of the static frictional force between the external thread of the collimator and the internal thread of the housing. The The screwing is terminated when dynamic frictional force exceeds the static frictional force, but if rotation in the anticlockwise direction is continued, the threads on the collimator and the jig become disengaged due to the effect of the static frictional force between the collimator and the housing, and can be detached.

Before and after the attachment and the detachment, the collimator and the jig are fixed by the thread, so that accurate carriage of the collimator and accurate positional alignment become possible.

Figure 3A:
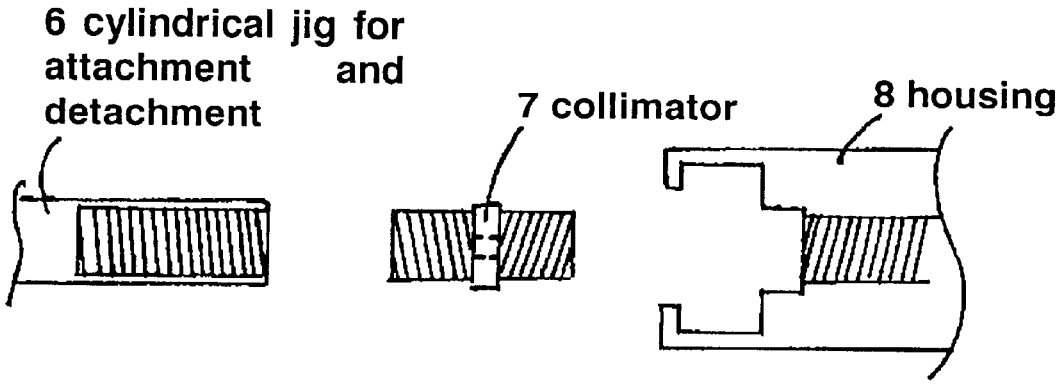
FIG. 3A is a schematic drawing showing a variation of the collimator attachment and detachment mechanism relating to the first embodiment of the present invention.

Also, as shown in FIG. 3A, the left-hand thread can be provided between the collimator 7 and the housing 8, and the thread can be provided between the collimator 7 and the jig 6.

Figure 3B:
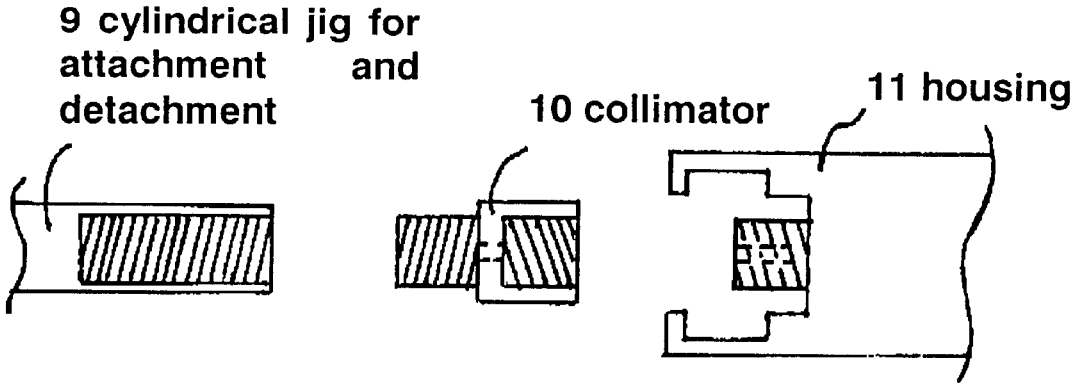
FIG. 3B is a schematic drawing showing a variation of the collimator attachment and detachment mechanism relating to the first embodiment of the present invention.

As shown in FIG. 3B, for the threads between the collimator 10 and the housing 11, the internal thread can be provided on the collimator side, and the external thread can be provided on the housing side.

The relationship between the threads of the collimator and the housing in the first embodiment of this invention can be applied to the collimator and X-ray generator attachment and detachment mechanism.

Additionally, the relationship between the threads of the collimator and the housing in the first embodiment of this invention can be applied to the collimator and X-ray detector attachment and detachment mechanism.

(Second Embodiment)

Figure 4:
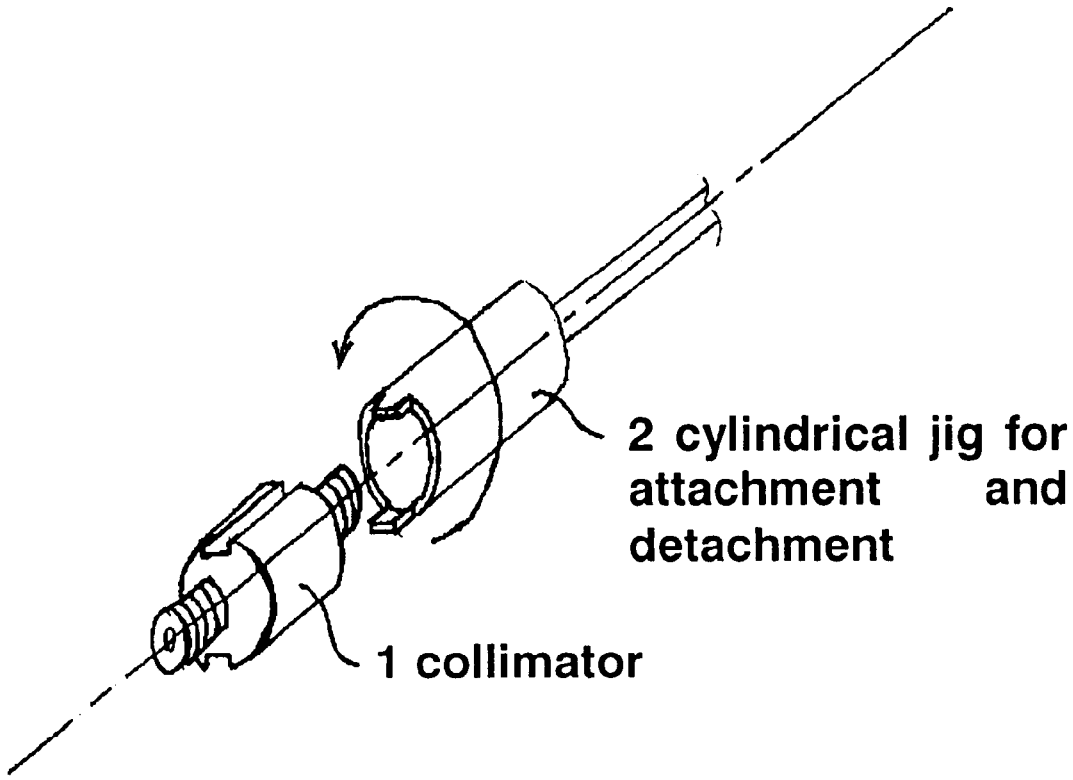
FIG. 4 is a schematic drawing showing the structure of the collimator tightening mechanism relating to the second embodiment of the present invention.

A second embodiment of the present invention will be described in the following based on FIG. 4.

A notch for an indentation is placed at a point symmetrical with a certain point on the outer periphery of the collimator with respect to a central point of the collimator.

A hook of the projection section is also provided on the opposite side to the side having the internal thread of the cylindrical jig for attachment and detachment 2, so as to be lined up with the indentation.

After attaching the collimator to the housing, it is possible to tighten up by aligning the projection of the jig with the indentation of the collimator and rotating in a clockwise direction.

This tightening mechanism is also applicable when the projection is provided on the collimator, and the indentation is provided on the jig.

The mechanism for tightening the threads of the collimator and the housing in the second embodiment of this invention can be applied to tightening of the collimator and the X-ray generator.

Additionally, the mechanism for tightening the threads of the collimator and the housing in the second embodiment of this invention can be applied to tightening of the collimator and the X-ray detector.

In the following, the first embodiment according to the invention will be explained referring to the drawings.

What is claimed is:

1. An X-ray fluorescence analysis apparatus comprising: an X-ray generator; an X-ray detector; a housing; and a collimator for defining a range for the passage of X-rays from the X-ray generator; wherein a right-hand screw thread is provided on a first side of the collimator for attachment of the collimator to the housing and detachment of the collimator from the housing, a corresponding right-hand screw thread is provided in the housing for receiving the right-hand screw thread provided on the collimator, and a left-hand screw thread is provided on a second side of the collimator opposite the first side coaxial with the right-hand screw thread for attachment of the collimator to an attachment jig for attachment of the collimator to the housing and detachment of the collimator from the housing.

2. An X-ray fluorescence analysis apparatus according to claim 1; wherein the collimator is provided with an indentation or projection for tightening.

3. An X-ray fluorescence analysis apparatus according to claim 1; wherein the right-hand screw thread of the collimator is an external screw thread and the right-hand screw thread of the housing is an internal screw thread.

4. An X-ray fluorescence analysis apparatus according to claim 1; wherein the right-hand screw thread of the collimator is an internal screw thread and the right-hand screw thread of the housing is an external screw thread.

5. An X-ray fluorescence analysis apparatus according to claim 1; wherein the attachment jig has a left-hand screw thread for receiving the left-hand screw thread of the collimator for screwing the collimator into the right-hand screw thread of the housing and unscrewing the collimator from the right-hand screw thread of the housing.

6. An X-ray fluorescence analysis apparatus comprising: an X-ray generator; an X-ray detector; a housing; and a collimator for defining a range for the passage of X-rays from the X-ray generator; wherein a right-hand screw thread is provided on a first side of the collimator for attachment of the collimator to the X-ray generator and detachment of the collimator from the X-ray generator, a corresponding right-hand screw thread is provided in the X-ray generator for receiving the right-hand screw thread provided on the collimator, and a left-hand screw thread is provided on a second side of the collimator opposite the first side coaxial with the right-hand screw thread for attachment of the collimator to an attachment jig for attachment of the collimator to the X-ray generator and detachment of the collimator from the X-ray generator.

7. An X-ray fluorescence analysis apparatus according to claim 6; wherein the collimator is provided with an indentation or projection for tightening.

8. An X-ray fluorescence analysis apparatus according to claim 6; wherein the right-hand screw thread of the collimator is an external screw thread and the right-hand screw thread of the X-ray generator is an internal screw thread.

9. An X-ray fluorescence analysis apparatus according to claim 6; wherein the right-hand screw thread of the collimator is an internal screw thread and the right-hand screw thread of the X-ray generator is an external screw thread.

10. An X-ray fluorescence analysis apparatus according to claim 6; wherein the attachment jig has a left-hand screw thread for receiving the left-hand screw thread of the collimator for screwing the collimator into the right-hand screw thread of the X-ray generator and unscrewing the collimator from the screw thread of the X-ray generator.

11. An X-ray fluorescence analysis apparatus comprising: an X-ray generator; an X-ray detector; a housing; and a collimator for defining a range for the passage of X-rays from the X-ray generator; wherein a right-hand screw thread is provided on a first side of the collimator for attachment of the collimator to the X-ray detector and detachment of the collimator from the X-ray detector, a corresponding right-hand screw thread is provided in the X-ray detector for receiving the right-hand screw thread provided on the collimator, and a left-hand screw thread is provided on a second side of the collimator opposite the first side coaxial with the right-hand screw thread for attachment of the collimator to an attachment jig for attachment of the collimator to the X-ray detector and detachment of the collimator from the X-ray detector.

12. An X-ray fluorescence analysis apparatus according to claim 11; wherein the collimator is provided with an indentation or projection for tightening.

13. An X-ray fluorescence analysis apparatus according to claim 11; wherein the right-hand screw thread of the collimator is an external screw thread and the right-hand screw thread of the X-ray detector is an internal screw thread.

14. An X-ray fluorescence analysis apparatus according to claim 11; wherein the right-hand screw thread of the collimator is an internal screw thread and the right-hand screw thread of the X-ray detector is an external screw thread.

15. An X-ray fluorescence analysis apparatus according to claim 11; wherein the attachment jig has a left-hand screw thread for receiving the left-hand screw thread of the collimator for screwing the collimator into the right-hand screw thread of the X-ray detector and unscrewing the collimator from the screw thread of the X-ray detector.

16. An X-ray apparatus comprising: an X-ray generator for generating X-rays; an X-ray detector for detecting X-rays; a housing attached to at least one of the X-ray generator and the X-ray detector; a collimator for collimating X-rays generated by the X-ray generator; and a first screw thread formed on one of the X-ray generator, the X-ray detector and the housing for receiving the collimator; wherein the collimator has a second screw thread on a first side for mounting the collimator to the first screw thread and a third screw thread on a second side having a threading direction opposite from that of the second screw thread for attachment to a mounting jig.

17. An X-ray apparatus according to claim 16; wherein the first screw thread is a right-hand screw thread, the second screw thread of the collimator is a right-hand screw thread, and the third screw thread of the collimator is a left-hand screw thread.

18. An X-ray apparatus according to claim 17; wherein the right-hand screw thread of the collimator is an external screw thread and the first screw thread is an internal screw thread.

19. An X-ray apparatus according to claim 17; wherein the right-hand screw thread of the collimator is an internal screw thread and the first screw thread is an external screw thread.

20. An X-ray apparatus according to claim 16; wherein the collimator has one of an indentation or a projection for tightening, and the mounting jig has the other one of an indentation or a projection corresponding to the indentation or projection of the collimator.

* * * * *